US010087670B2

(12) United States Patent
Grabher

(10) Patent No.: US 10,087,670 B2
(45) Date of Patent: Oct. 2, 2018

(54) DAMPING DEVICE

(71) Applicant: Grass GmbH, Höchst (AT)

(72) Inventor: Günter Grabher, Fussbach (AT)

(73) Assignee: Grass GmbH, Höchst (AT)

( * ) Notice: Subject to any disclaimer, the term of this patent is extended or adjusted under 35 U.S.C. 154(b) by 0 days.

(21) Appl. No.: 15/187,288

(22) Filed: Jun. 20, 2016

(65) Prior Publication Data

US 2016/0319582 A1 Nov. 3, 2016

Related U.S. Application Data

(63) Continuation of application No. PCT/EP2014/003311, filed on Dec. 11, 2014.

(30) Foreign Application Priority Data

Dec. 23, 2013 (DE) ..... 20 2013 011 559 U

(51) Int. Cl.
*E05F 5/00* (2017.01)
*E05F 5/02* (2006.01)
(Continued)

(52) U.S. Cl.
CPC ..... *E05F 5/003* (2013.01); *A47B 88/40* (2017.01); *A47B 88/483* (2017.01);
(Continued)

(58) Field of Classification Search
CPC ..... A47B 88/04; A47B 88/12; A47B 88/14; A47B 88/40; A47B 88/487; A47B 88/483; E05F 5/003; E05F 5/02
See application file for complete search history.

(56) References Cited

U.S. PATENT DOCUMENTS 3,142,517 A * 7/1964 Ward ..... A47B 88/483 108/137
3,356,435 A * 12/1967 Hanson ..... A47B 88/57 16/82
(Continued)

FOREIGN PATENT DOCUMENTS

DE 8013283 U1 8/1980
DE 3716923 A1 12/1988
(Continued)

OTHER PUBLICATIONS

International Search Report in corresponding International Application No. PCT/EP2014/003311, dated Feb. 24, 2015, with English Translation.

*Primary Examiner* — Hanh V Tran
(74) *Attorney, Agent, or Firm* — Edell, Shapiro & Finnan LLC

(57) ABSTRACT

A damping device for damping the opening movement of a moveable furniture part comprises a base unit and a movement unit that is moveable in relation to the base unit. The base unit comprises a furniture body of a piece of furniture and a first damping mechanism having a first clamping mechanism. The movement unit comprises the furniture part and a second damping mechanism that dampens an end position when the moveable furniture part approaches the open position. The second damping mechanism has a second clamping mechanism. The first and second clamping mechanisms can be detachably and dynamically clamped to one another for damping the movement of the moveable furniture part when the moveable furniture part approaches the open position.

4 Claims, 9 Drawing Sheets

(51) Int. Cl.
*A47B 88/40* (2017.01)
*A47B 88/483* (2017.01)
*A47B 88/487* (2017.01)

(52) U.S. Cl.
CPC ..... *A47B 88/487* (2017.01); *E05F 5/02* (2013.01); *A47B 2210/0094* (2013.01)

(56) References Cited

U.S. PATENT DOCUMENTS 3,386,784 A * 6/1968 Oppenhuizen ..... A47B 88/57 312/334.19
3,574,437 A * 4/1971 Stein ..... A47B 88/487 312/334.19
4,162,114 A * 7/1979 Litchfield ..... A47B 88/941 312/334.1
4,165,907 A * 8/1979 Rock ..... A47B 88/493 384/19
4,304,449 A * 12/1981 Litchfield ..... A47B 88/941 312/334.18
4,494,802 A * 1/1985 Henson ..... A47B 88/487 384/19
4,799,802 A * 1/1989 Lautenschlager .... A47B 88/467 384/19
5,344,227 A * 9/1994 Rock ..... A47B 88/467 312/334.33
6,257,683 B1 * 7/2001 Yang ..... A47B 88/487 312/333
6,402,275 B1 * 6/2002 Yang ..... A47B 88/487 312/333
6,789,862 B2 * 9/2004 Shih-Long ..... A47B 88/49 312/334.46
8,201,901 B2 * 6/2012 Craddock ..... A47B 88/493 312/334.11
8,845,043 B2 * 9/2014 Bonat ..... A47B 88/14 312/334.13
9,161,626 B2 * 10/2015 Zimmermann ..... A47B 88/57
9,204,721 B2 * 12/2015 Gasser ..... A47B 88/04
2002/0140331 A1 * 10/2002 Chen ..... A47B 88/493 312/334.46
2004/0174102 A1 * 9/2004 Chen ..... A47B 88/487 312/334.46
2004/0174104 A1 * 9/2004 Chen ..... A47B 88/487 312/334.47
2007/0222346 A1 * 9/2007 Kleinsasser ..... A47B 88/463 312/205
2009/0072687 A1 * 3/2009 Fitz ..... E05F 1/105 312/319.5
2010/0293746 A1 * 11/2010 Johansson ..... E05F 1/16 16/85
2014/0294328 A1 * 10/2014 Pecar ..... A47B 88/04 384/20

FOREIGN PATENT DOCUMENTS

DE 19824167 A1 12/1999
DE 29916841 U1 12/1999
DE 202004001794 U1 5/2004
EP 1275325 A1 1/2003
EP 1743550 A1 1/2007
WO 2007017688 A1 2/2007

* cited by examiner

DAMPING DEVICE

CROSS REFERENCE TO RELATED APPLICATIONS

This application is a continuation of International Application No. PCT/EP2014/003311, filed on Dec. 11, 2014, which claims priority under 35 U.S.C. § 119 to Application No. DE 202013011559.9 filed on Dec. 23, 2013, the entire contents of which are hereby incorporated by reference.

FIELD OF THE INVENTION

The invention relates to a damping device for damping the opening movement of a moveable furniture part, the damping device comprising a base unit having a furniture body of a piece of furniture and comprising a movement unit that is moveable in relation to the base unit and comprises the furniture part, which base unit has a first damping mechanism and which movement unit has a second damping mechanism, the damping mechanism damping an end position when the moveable furniture part approaches the open position.

BACKGROUND

Such damping devices are already known. A displacement device for furniture extensions is described in EP 1 743 550 A1, for example, in which the retraction of a drawer into the open position is dampened via a damping device. The damping device comprises a fluidic damper, having a damper housing, into which a damper piston is guided in a linearly displaceable manner. The damper piston is connected to a plunger rod leading through the damper housing, which absorbs the movement during retraction into the open position thus causing the damper piston to move in a damping medium into the damper housing which in turn causes a slowing down or attenuation of the opening movement.

SUMMARY

The object of the invention is to create a damping device of the type referred to above, which is easy to assemble, can be manufactured cost-effectively, and managed reliably.

The damping device according to the invention is characterized in that a first damping mechanism has a first clamping mechanism and a second damping mechanism has a second clamping mechanism, which clamping mechanisms can be dynamically locked together in a detachable manner in order to dampen the movement of the moveable furniture part when the moveable furniture part approaches the open position.

The damping device is therefore configured to be mechanically effective by virtue of the clamping mechanisms. This means that damping media, which are used in fluid dampers of conventional damping devices, for example, can be dispensed with.

In a further embodiment of the invention, the clamping mechanisms are configured such that they can be dynamically locked together in a gradual manner. It is therefore possible that the clamping effect generated by the clamping mechanisms increases when approaching the open position.

In a further embodiment of the invention, the base unit has a body rail for a guide device attached or attachable to the furniture body for guiding the moveable furniture part into the furniture body, wherein the first clamping mechanism is arranged on the body rail.

In a particularly preferred manner, the first clamping mechanism is arranged, in an assembled state of the body rail, on a front mounting interface located in the vicinity of a furniture compartment opening.

Moveable furniture parts within the meaning of the invention can be drawers, doors or flaps.

As an alternative to the arrangement of the first clamping mechanism on the body rail, it would also be possible to arrange the first clamping mechanism on the furniture body of a piece of furniture. A mounting interface on the bottom of a drawer retainer or a drawer compartment, in particular a front mounting interface located in the vicinity of the compartment opening would be possible, for example.

In a further embodiment of the invention, the movement unit has at least one runner for a guide device for guiding the moveable furniture part into the furniture body, wherein the second clamping mechanism is arranged on the runner. In a particularly preferred manner, both clamping mechanisms associated with one another, are arranged firstly on the body rail and secondly on the runner.

In the case of a moveable furniture part configured as a drawer, the runner is a drawer runner.

It would also be possible, however, to arrange the second clamping mechanism on the moveable furniture part itself, i.e., on the drawer, for example on the bottom of the drawer.

In a particularly preferred manner the movement unit has at least two runners, of which at least one runner is configured as a central rail moveably guided between the body rail and a further runner, in particular drawer runner. A guide device of this type is also described as a full extension.

In a further embodiment of the invention, the first and second clamping mechanisms have a clamping member and a wedge assigned to the clamping member, which engage with each other creating a deadlock when the moveable furniture part approaches the open position.

In a particularly preferred embodiment, the clamping member is part of the first clamping mechanism while the wedge is part of the second clamping mechanism. In a particularly preferred manner, the clamping member is arranged on the body rail and the wedge on the drawer rail.

In a further embodiment of the invention, the clamping member has a spring catch that is spring loaded using springs, with which the wedge engages when the moveable furniture part is retracted into the open position, such that the wedge acts on the spring catch against the spring force of the springs and the resulting clamping force between wedge and spring catch causes a slowing down of the opening movement.

Alternatively or in addition, it is possible that the clamping member is configured as a rotatably mounted clamp roller that can be rolled along a clamping surface of the wedge.

In a further embodiment of the invention, the first and second clamping mechanisms have a clamping collar and clamping unit assigned to the clamping collar, which clamping unit has a clamp gap into which the clamping collar can be locked when the moveable furniture part approaches the open position.

In a particularly preferred manner, the clamping unit is part of the first clamping mechanism and the clamping collar is part of the second clamping mechanism, wherein the clamping collar retracts into the clamp gap of the clamping unit when approaching the open position. Preferably, the clamping collar is arranged on the drawer rail and clamping unit on the body rail or on the furniture body.

It is possible that the clamping collar is configured as plate-like or strip-like.

In a particularly preferred manner, the clamping unit has at least one clamping element moveably mounted on the clamping unit between a basic position and a locked position, which in the locked position thereof narrows the width of the clamping gap such that the clamping collar is clamped between it and a counter flange element also configured on the clamping unit.

In a particularly preferred manner, the clamping element is configured as a clamp roller that can be rolled along an inclined plane rising in the retraction direction of the clamping collar, the running surface of which clamping element protrudes slightly into the clamp gap, whereby the running surface can be travelled over by the clamping collar, which causes the clamp roller that has been travelled over to be displaced upwards on the assigned inclined plane into the locked position. As a result of the locking of the clamping collar, the at least one clamp roller and the counter flange element, the moveable furniture part is confined in the opening direction and can be pulled into the end position manually if required.

In a further embodiment of the invention, a plurality of clamp rollers are provided which are arranged one behind the other and can be travelled over one after the other in the retraction direction of the clamping collar. This reduces the risk that if the speed of the moveable furniture part is too high, the clamping collar passes through the clamping gap and no deadlock occurs.

In a further embodiment of the invention, the clamping mechanisms have at least one roller carriage moveably guided into a running channel between the drawer rail and the central rail and a narrow section reducing the cross-section of the running channel, wherein the roller carriage can be retracted into the narrow section when approaching the open position and locked there by the side walls of the running channel.

The damping device according to the invention is characterized in that the first or second damping mechanism has a rotation damper and the second or first damping mechanism has an actuator to activate the rotation damper in order to dampen the opening movement.

In a preferred manner, the actuator is located on the movement unit and the rotation damper on the base unit. However, in principle, an inverted arrangement would also be possible, with the actuator on the base unit and the rotation damper on the movement unit.

In a particularly preferred manner, the rotation damper has a gear wheel and the actuator is configured as a gear rack, which engages with the gear wheel to activate the rotation damper.

The invention also comprises a piece of furniture having at least one moveable furniture part, in particular a drawer, which is characterized by the described clamping device.

BRIEF DESCRIPTION OF THE DRAWINGS

Preferred embodiments of the invention are shown in the drawings and are explained in detail below in which.

DETAILED DESCRIPTION

Figure 1:
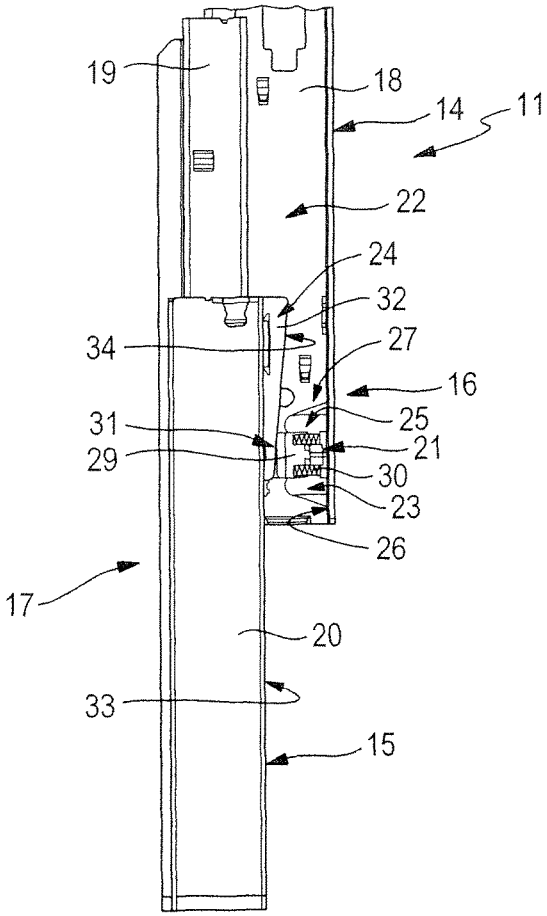
FIG. 1 shows a top view of a first embodiment of the damping device according to the invention prior to retraction into the open position.
Figure 2:
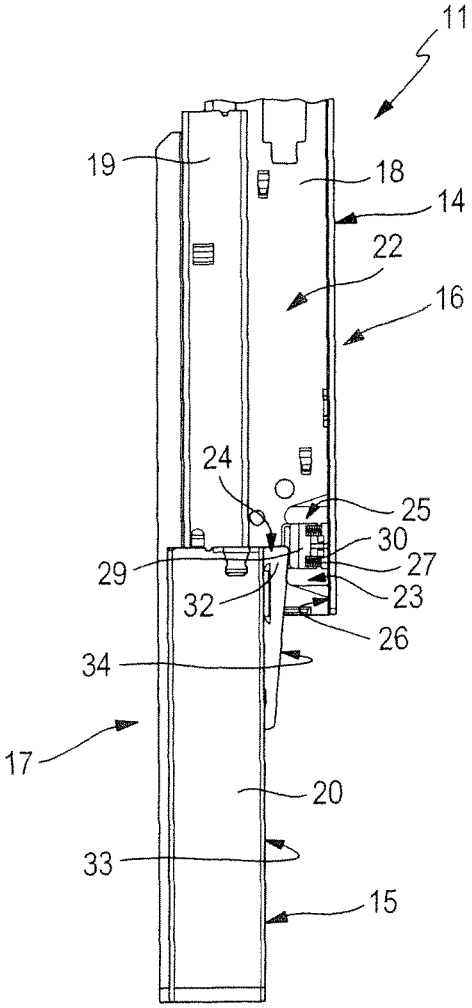
FIG. 2 shows the damping device from FIG. 1 in the open position.

FIGS. 1 and 2 show a first embodiment of the damping device 11 according to the invention for damping the opening movement of a moveable furniture part. The damping device 11 can be used on a moveable furniture part configured as a drawer, for example. Naturally, it is also possible to use the damping device 11 on other moveable furniture parts, such as a door or flap, for example.

The invention is described in detail below using the example of a moveable furniture part configured as a drawer.

The damping device 11 comprises a base unit 14 having a furniture body 13 of a piece of furniture and a movement unit 15 that is moveable in relation to the base unit 14 and comprises the furniture part.

The drawer is displaceably mounted in relation to the furniture body 13 via a guide device 16. The guide device 16 comprises a plurality of guide units 17, which are assigned to opposing side edges of the drawer.

The guide units 17 each have a body rail 18, which is attached in a fixed position using an appropriate attachment mechanism to an assigned side wall of a drawer recess or drawer compartment configured in the furniture body 13. In addition to the furniture body 13, the body rail 18 is part of the base unit 14.

A central rail 19 is displaceably mounted on the body rail 18, for example, on which, in turn, a runner 20 is displaceably guided by bearings. The runner 20, which can also be called a movement rail, or in the present case a drawer rail, is assigned to the drawer and runs underneath the bottom of the drawer in a depth direction. The combination of body rail 18, central rail 19 and runner 20 is called full extension. However, using guide units 17 without central rails 19 is also possible.

In order to attenuate the retraction of the drawer into the open position, the damping device 11 of the base unit 14 has assigned first damping mechanism 21 and the movement unit 15 has assigned second damping mechanism.

The interaction of the first and second damping mechanisms 21, 22 ensures damping of an end position of the moveable furniture part on retraction into the open position.

The first damping mechanism 21 has a first clamping mechanism for this purpose, which is thus assigned to the base unit 14. Moreover, the second damping mechanism has a second clamping mechanism 24, which is assigned to the movement unit 15.

As shown particularly in FIGS. 1 and 2 using the first embodiment of the invention, the first clamping mechanism has a clamping member 25, which is attached to the body rail 18 using a suitable attachment mechanism.

In the example shown, the clamping member 25 is housed between two ribs of a reinforcing bead 27 formed from the material of the body rail 18. The reinforcing bead 27 projects from a mounting section 26 of the body rail 18 and runs on a bearing section of the body rail 18. The mounting section 26 is attached to the side wall of the drawer recess using a suitable attachment mechanism, such as fastening screws, for example. The clamping member 25 has a spring catch 29 which is spring loaded using springs. In the example shown, two compression springs 30 are provided, which are supported firstly on the base of the reinforcing bead 27 and secondly, on the spring catch 29. The compression springs 30 press the spring catch 29 outwards from the reinforcing bead 27. The spring catch 29 has a clamping surface 31 on the front side thereof.

The second clamping mechanism 24 has a wedge 32, which is attached at the rear end of the runner 20. The wedge 32 is located on the side panel 33 assigned to the mounting section 26 of the body rail 18 and projects outwards therefrom. The wedge 32 broadens towards the rear end of the runner 20 as a result of which the distance between the outer surface of the wedge 32 and the mounting section 26 decreases towards the rear end of the runner 20. The outer surface of the wedge 32 forms a counter-clamping surface 34, which is assigned to the clamping surface 31 on the spring catch 29.

When opening, the drawer is pulled out of the drawer recess or the drawer compartment. On retraction into the open position, the counter-clamping surface 34 on the wedge 32 comes into contact with the clamping surface 31 of the spring catch 29. Since the wedge 32 becomes wider towards the back, the spring catch is pushed counter to the spring force of the spring catches 30 into the reinforcing bead 27, i.e., in the direction of the mounting section 26, on further movement of the runner 20. A clamping force acts between the clamping surface 31 and the counter-clamping surface 34, which slows down the opening movement of the runner and thus the drawer on retraction into the open position. This dampens the opening movement. Based on Hooke's law, the wedge 32 and the spring catch 29 lock gradually, i.e., the clamping force increases when approaching the open position as the spring catches 30 are shortened further on retraction into the open position as a result of which the spring force increases.

Figure 3:
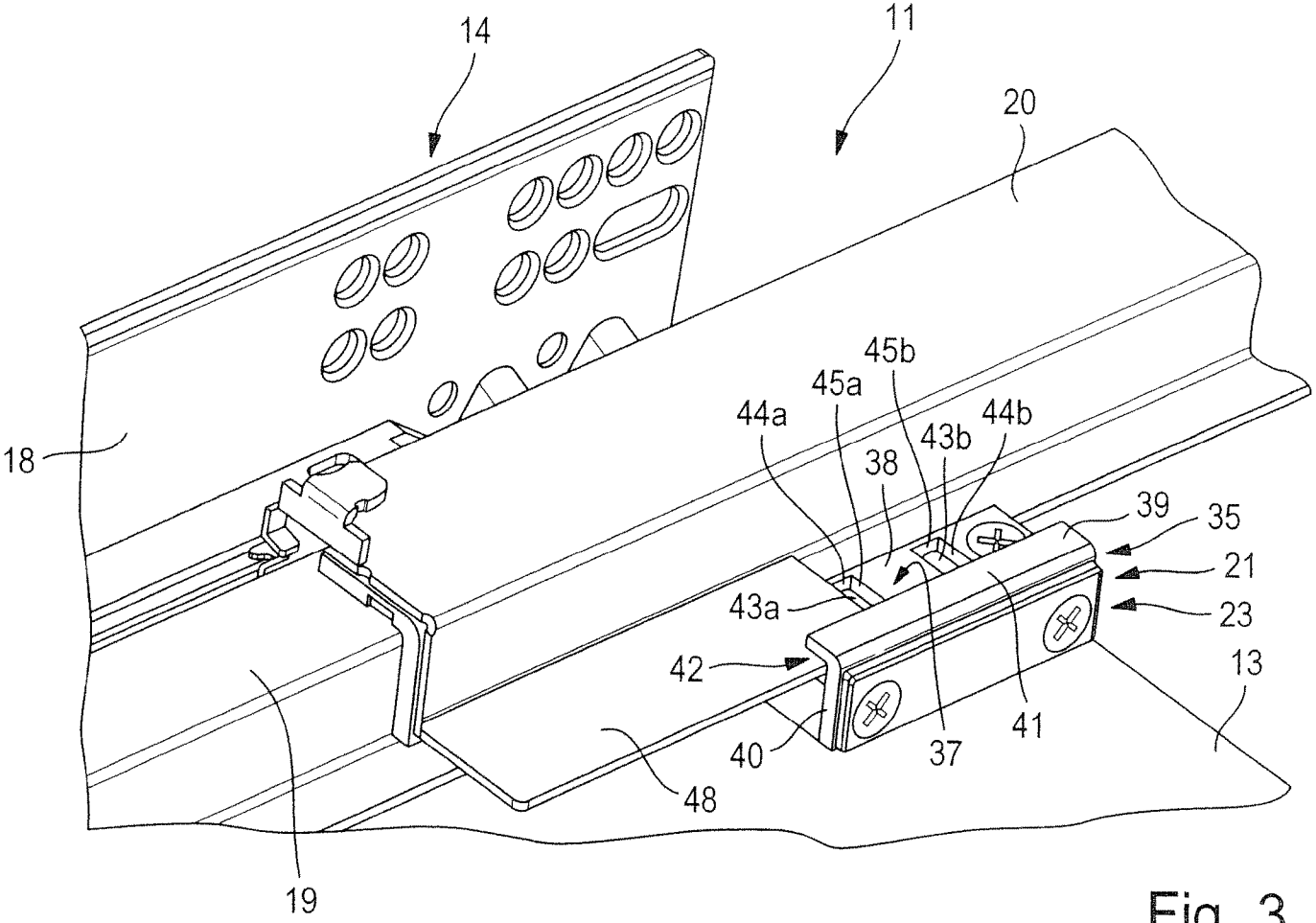
FIG. 3 shows an enlarged schematic perspective view of a second embodiment of the damping device according to the invention on retraction into the open position.
Figure 4:
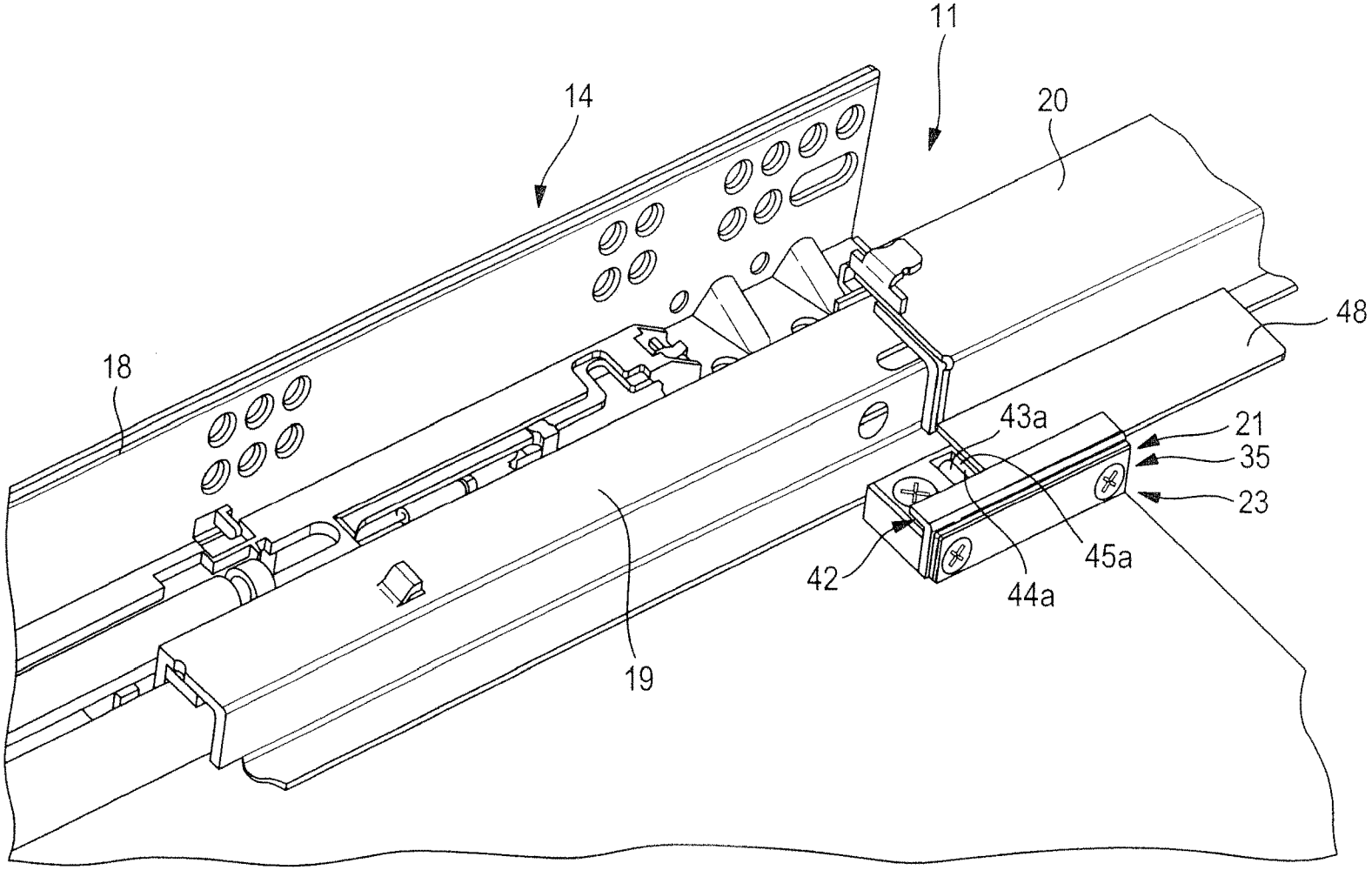
FIG. 4 shows a perspective, schematic view of the damping device from FIG. 3 in the open position of the moveable furniture part.
Figure 5:
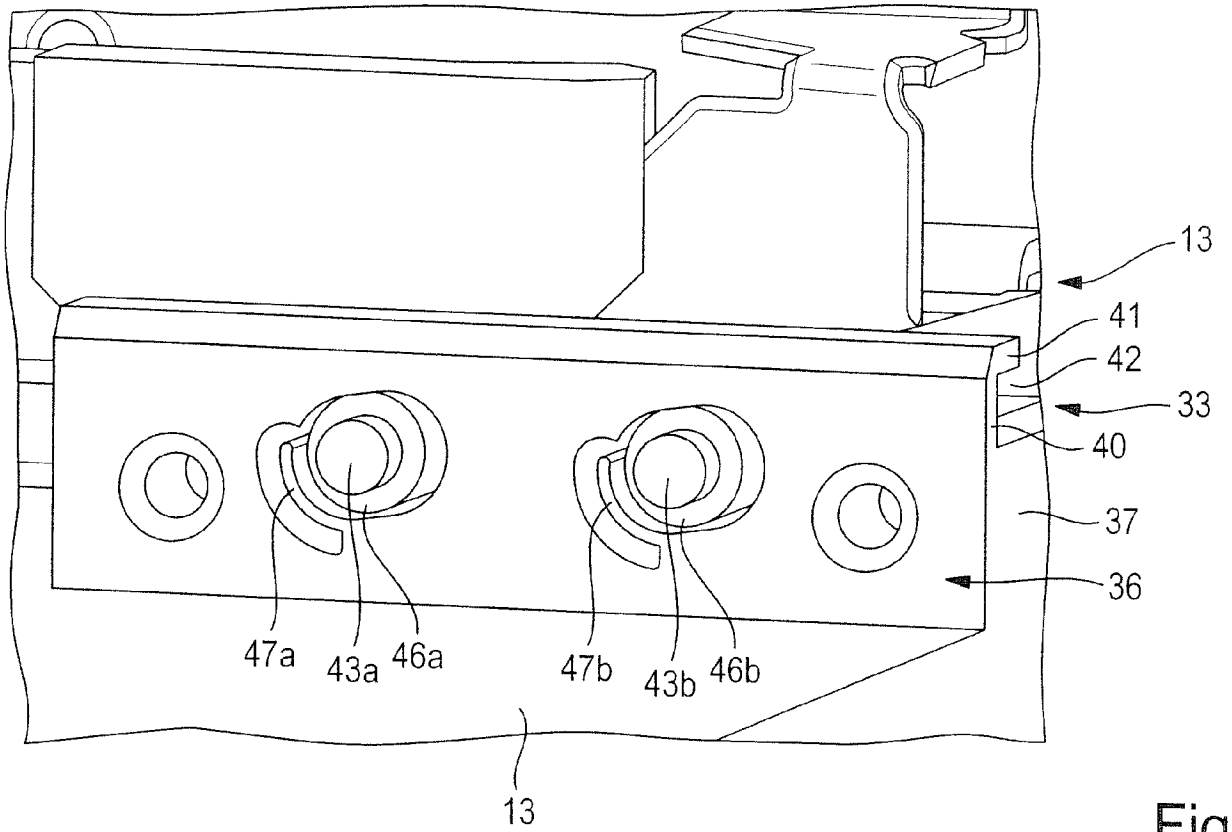
FIG. 5 shows a perspective view of components of the damping device from FIG. 3.

FIGS. 3 to 5 show a second embodiment of the damping device 11 according to the invention. First clamping mechanism 23 is assigned to first damping mechanism 21 and second clamping mechanism 24 is assigned to second damping mechanism 22 here too. As shown particularly in FIG. 3, the first clamping mechanism 23 assigned to the base unit 14 has a clamping unit 35, which is attached to the bottom of the drawer recess using a suitable attachment mechanism, such as fastening screws, for example. Advantageously, the front end of the clamping unit 35 in essence directly adjoins the drawer compartment opening. The clamping unit can also be connected to the body rail via/on a mounting plate.

As shown particularly in FIG. 3, the clamping unit 35 has a base unit 36 having a plurality of functional parts. The base unit 36 has an attachment part 37 with two through holes through which fastening screws can be guided and screwed into the bottom of the drawer recess for attachment purposes. The attachment part 37 has an upper side 38 on one edge of which a counter flange part 39 attached integrally to the attachment part 37 is located. The counter flange part 39 is configured as an angle section, wherein a first side piece 40 extends upwards from the upper side 38 of the attachment part 37. A second side piece 41 integrally attached to the first side piece 40 and located thereon, extends from the first side piece 40 parallel to the upper side above part of the upper side 38. The second side piece 41, in particular the underside thereof and the upper side 38 of the attachment part 37 together form a clamp gap 42.

The clamping unit 35 also has at least one clamping element in the form of a clamp roller 43 that is moveable between a basic position and a locked position and is mounted on the clamping unit 35. Advantageously, a plurality of clamp rollers 43 are provided, of which a first and a second clamp roller 43*a*, 43*b*, for example, are shown in FIGS. 3 to 5.

The clamp rollers 43*a*, 43*b* are each loosely housed in clamp roller receptacles 44*a*, 44*b* in the attachment part 37 of the base unit 36 of the clamping unit 35. As shown particularly in FIG. 5, the clamp rollers 43*a*, 43*b* are mounted in a freely rotatable manner in the respectively assigned clamp roller receptacles 44*a*, 44*b*.

As shown particularly in FIG. 3, part of the casing section of the cylindrical clamp rollers 43*a*, 43*b*, projects over assigned slit-shaped openings 45*a*, 45*b* into the clamp gap 42.

As shown particularly in FIG. 5, the respective clamp roller receptacles 44*a*, 44*b* have a plurality of functional parts with different functions. The clamp roller receptacles 44*a*, 44*b* are each configured in the form of an elongated hole. They each have an inclined plane 46*a*, 46*b*, which rises from the basic position of the clamp roller 43*a*, 43*b* shown in FIG. 6 in the pull-out direction of the drawer. The clamp rollers 43*a*, 43*b* can therefore be displaced from the locked position shown in FIG. 5 forwards and upwards into the locked position, in which a casing section of each of the clamp rollers 43*a*, 43*b* that is larger compared with the basic position projects from the assigned openings 45*a*, 45*b*. The clamp roller receptacles 44*a*, 44*b* also have a support portion 47*a*, 47*b* elastically deformable in the manner of a spring configured in the manner of a bearing seat, which support portion is effective during the closing movement of the drawer when the clamp rollers move backwards from the locked position into the basic position in the manner described below.

The second clamping mechanism 24 has a clamping collar, which, as shown particularly in FIG. 3, is arranged at the rear end of the runner 20 as a plate-shaped or strip-shaped element. Here the clamping collar 48 is arranged laterally on the side wall of the runner 20 assigned to the clamping unit 35 and can be formed from the material of the runner 20 for example.

When opening the drawer, the runner 20 moves out of the drawer recess wherein the clamping collar 48 engages with the clamping unit 35. In the process, the clamping collar 48 firstly travels over the first clamp roller 43*a* and takes said roller with it. As the first clamp roller 43*a* can be moved freely in the assigned clamp roller receptacle 44*a*, it is displaced upwards from the basic position into the locked position as a result of the further movement of the clamping collar 48 on the inclined plane 46*a* thereof. The clamping collar 48 then travels over the second clamp roller 43*b*, which, like the first clamp roller 43*a*, is also taken along and displaced upwards into its locked position. Both clamp rollers press the clamping collar 48 against the underside of the second side piece, in other words to the counter flange part 39, i.e., a clamp gap 42 is created between the clamp rollers and the underside of the second side piece 41. The clamping collar 48 is locked in said clamp gap 42 whereby the opening movement of the runner and thus the drawer is slowed down.

When the drawer is subsequently closed, the runner 20 goes back into the drawer recess in the closing direction whereby the clamping collar 48 moves the clamp rollers 43*a*, 43*b* back from the locked position to the basic position. In order that the clamping collar 48 comes clear, the respective support portions 47*a*, 47*b* bend downwards, whereby the clamp rollers 43*a*, 43*b* can be displaced slightly downwards so that they are displaced completely from the space between the upper side 38 of the attachment part 37 and the second side piece 41. This ensures a clamp-free backwards movement of the clamping collar 48. Once the clamping collar 48 has passed the clamping unit 35 in the closing direction, the elastic support portions 47*a*, 47*b* snap back again and the clamp rollers 43*a*, 43*b* return to their basic position.

Figure 6:
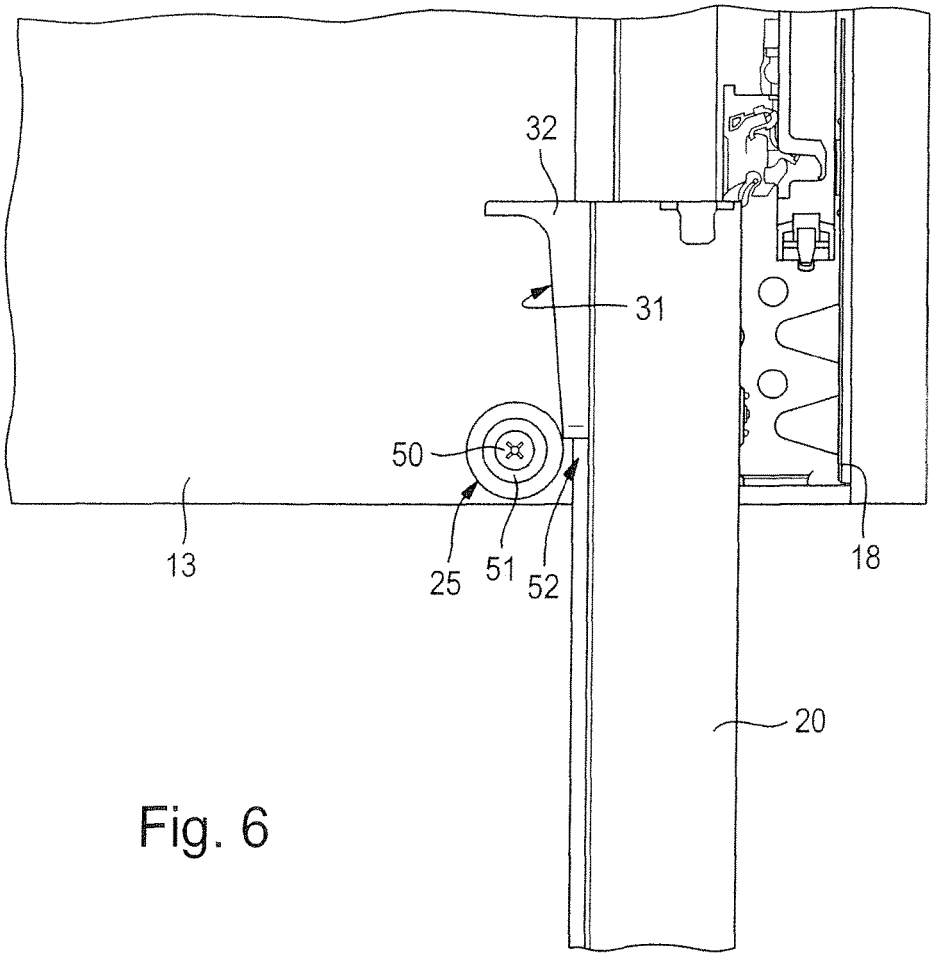
FIG. 6 shows a top view of a third embodiment of the damping device according to the invention on retraction of the moveable furniture part into the open position.
Figure 7:
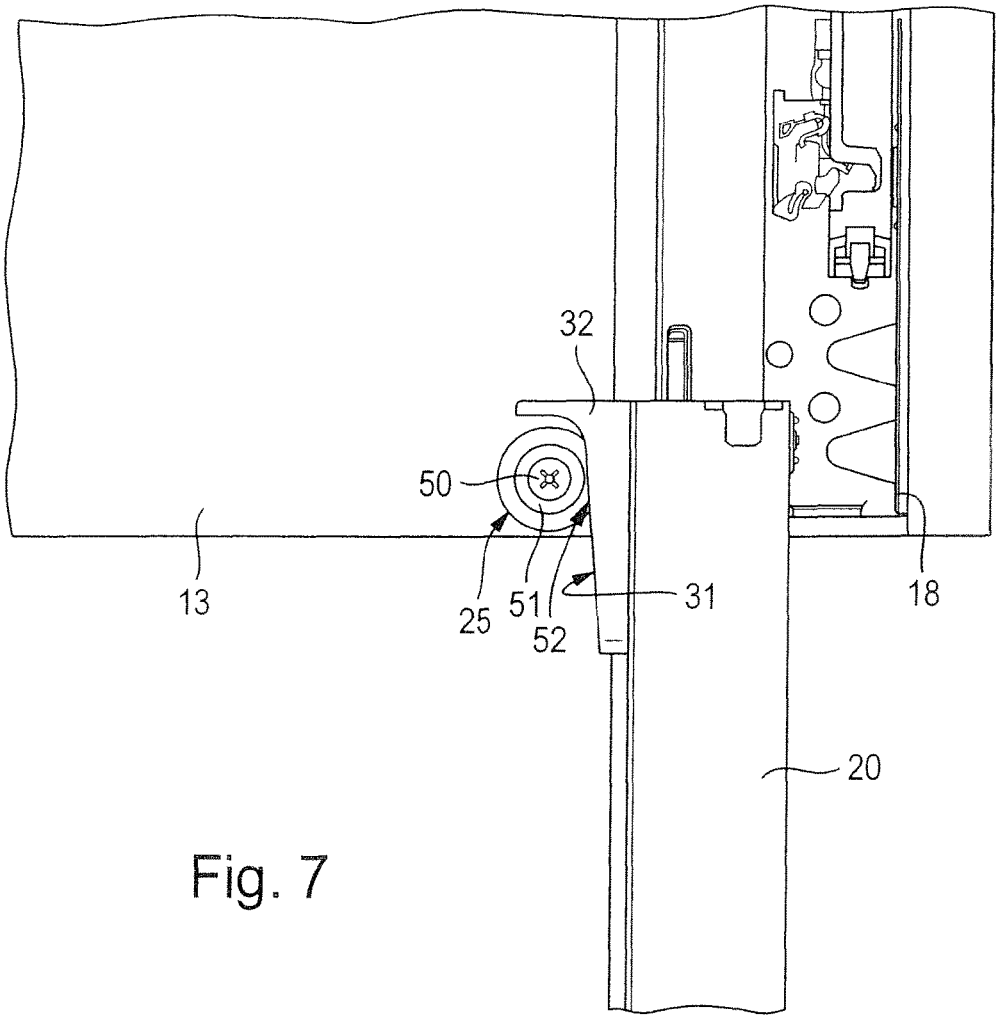
FIG. 7 shows a top view of the damping device from FIG. 6 with the moveable furniture part in the open position.

FIGS. 6 and 7 show a third embodiment of the damping device 11 according to the invention.

As in the case of the first embodiment described above, the first clamping mechanism 23 of the base unit 14 has a clamping member 25 whereas the second clamping mechanism 24 of the movement unit 15 has a wedge 32.

Unlike the first embodiment, the clamping member is configured as a rotatably mounted clamp roller that can be rolled along a clamping surface of the wedge 32. The clamp roller is mounted in a freely rotatable manner about a rotational axis 50. The rotational axis 50 is formed by a bearing pin 51, which for its part is attached using a suitable attachment mechanism to the bottom of the drawer recess or to a mounting plate attached there (not shown).

The wedge 32 is arranged on the rear end of the runner 20 and projects to the side from the side wall of the runner 20 facing the clamp roller. The wedge 32 has a clamping surface 31 on the outer side thereof. The wedge 32 extends towards the rear end of the runner 20. A gap 52 is configured between the outer side of the clamp roller and the side wall, which gap is filled by the wedge on retraction of the drawer into the open position.

The clamp roller can be formed from an elastically resilient material, such as a rubbery elastic material.

When opening the drawer, the runner 20 is moved out of the drawer recess. In the process, the wedge 32 comes into contact with the clamp roller. The clamp roller comes into contact with the clamping surface 31 of the clamp roller. The further outwards movement of the runner 20 causes an ever-widening section of the wedge to be displaced into the gap between clamp roller and side piece of the runner thereby slowing down the opening movement.

Figure 8:
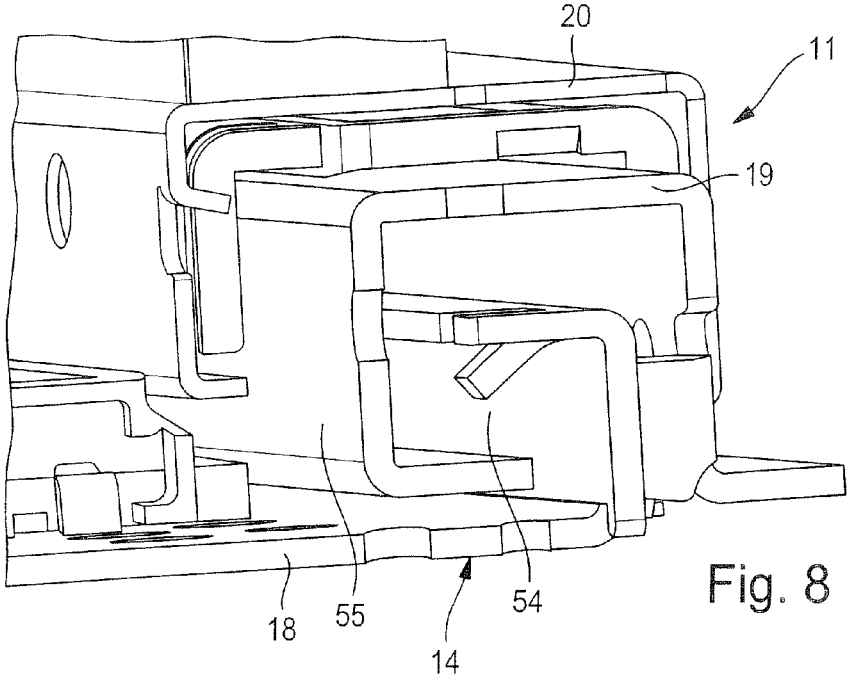
FIG. 8 shows a perspective view of a fourth embodiment of the damping device according to the invention.
Figure 9:
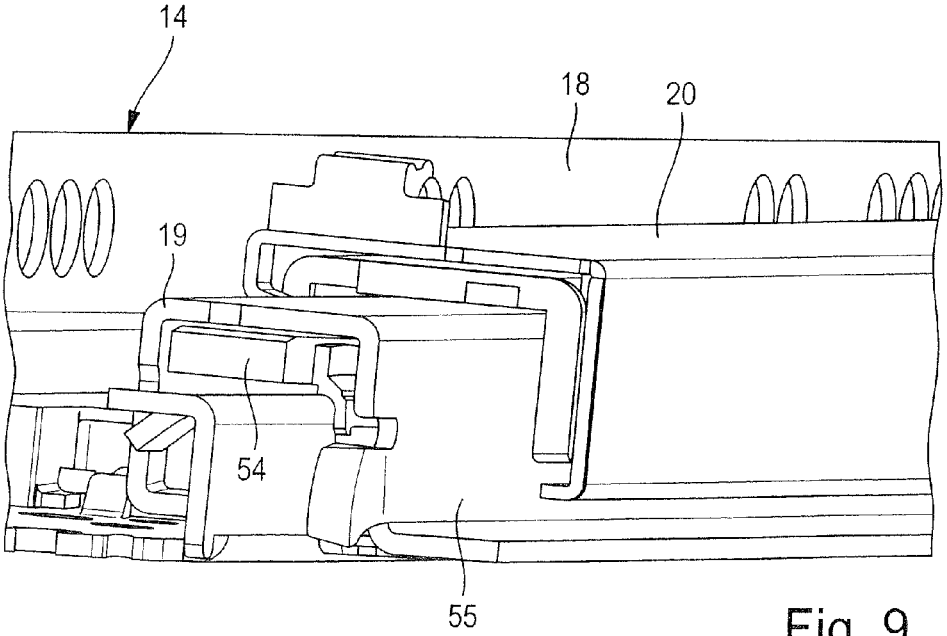
FIG. 9 shows a perspective view of the damping device from FIG. 8 from a different angle.
Figure 10:
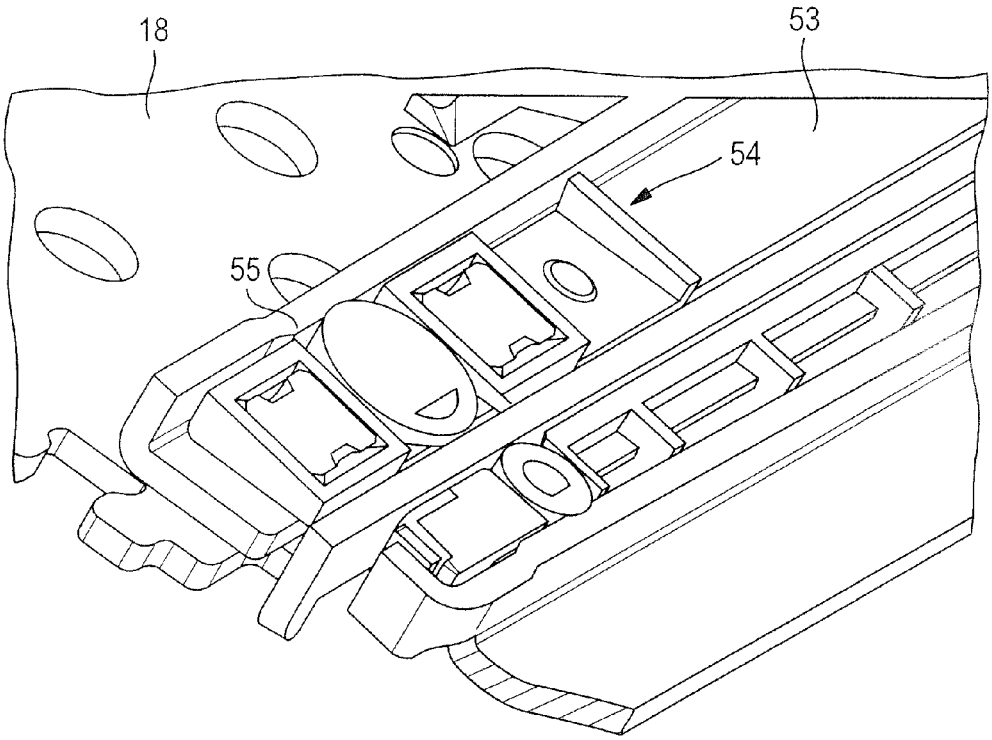
FIG. 10 shows a longitudinal section through the components of the damping device.

FIGS. 8-10 show a fourth embodiment of the damping device 11 according to the invention.

Here the clamping mechanism has at least one roller carriage 54 guided into a running channel 53 between the drawer rail or runner 20 and the central rail 19.

Moreover, a narrow section 55 reducing the cross-section of the running channel 53 is provided. The narrow section 55 is formed by a material section projecting inwards from the central rail into the running channel. When the drawer is opened, the roller carriage 54 is displaced into the running channel 53. On approaching the open position, the roller carriage 54 retracts into the narrow section 55 and is locked there by the side walls of the running channel thereby slowing down the opening movement.

Figure 11:
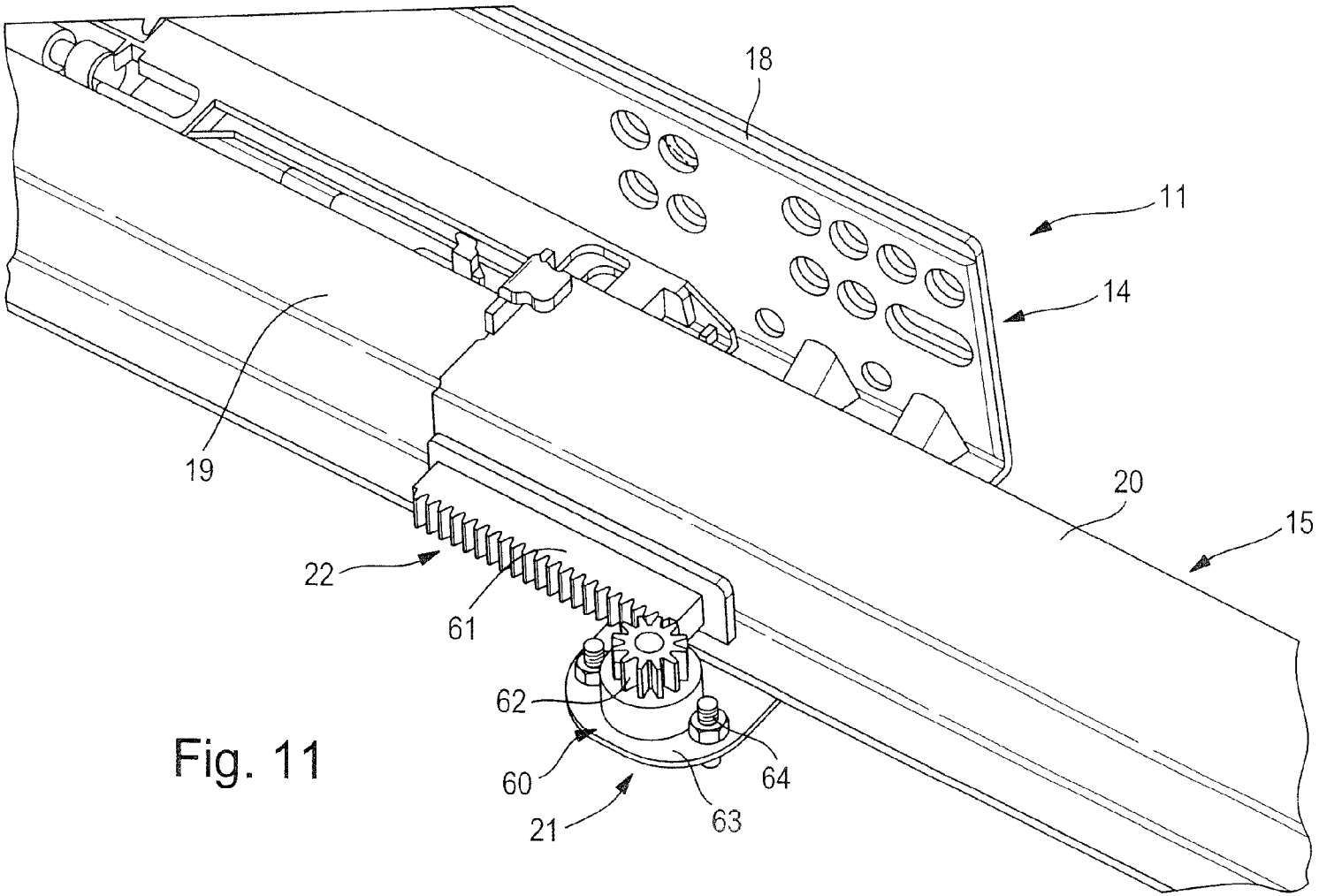
FIG. 11 shows a perspective view of a further embodiment of the damping device according to the invention.

FIG. 11 shows a further embodiment of the damping device 11 according to the invention, also shown by way of example when used on a moveable furniture part configured as a drawer. In this embodiment, the first damping mechanism 21 assigned to the base unit 14 has a rotation damper 60. The second damping mechanism 22 assigned to the movement unit 15 has an actuator 61 for activating the rotation damper.

The actuator is configured as a gear rack here, which sits on the rear end on the side wall of the runner 20 and the teeth of said gear rack projects inwards from there.

The rotation damper 60 is arranged on a mounting plate 63, which for its part is mounted on the bottom of the drawer compartment configured in the furniture body by mounting screws 64.

The rotation damper 60 has a gear wheel 62 rotatably mounted about a rotational axis, the rotational movement of which is slowed down by a damping medium, such as hydraulic oil, for example.

When opening the drawer, the gear rack engages with the rotation damper 60 in a specific open position of the drawer, which is shortly before the end stop. The gear wheel is thereby set in rotational motion and slows down the movement of the runner and consequently the drawer.

What is claimed is:

1. A damping device for damping the opening movement of a moveable furniture part, the damping device comprising:

a base unit comprising a furniture body of a piece of furniture and a first damping mechanism having a first clamping mechanism; and a movement unit that is moveable in relation to the base unit, the movement unit comprising the furniture part and a second damping mechanism to damp an end position when the moveable furniture part approaches the open position, the second damping mechanism having a second clamping mechanism, wherein the first and second clamping mechanisms are detachably and dynamically lockable together to damp the movement of the moveable furniture part when the moveable furniture part approaches the open position, wherein:

the base unit has a body rail of a guide device attached or attachable to the furniture body to guide the moveable furniture part into the furniture body;

the first clamping mechanism is arranged on the body rail;

the movement unit has at least one runner of a guide device for guiding the moveable furniture part into the furniture body, and the second clamping mechanism is arranged on the runner;

the first and second clamping mechanisms together comprise a clamping collar and a clamping unit assigned to the clamping collar, the clamping unit having a clamp gap into which the clamping collar is lockable when the moveable furniture part approaches the open position;

the clamping unit is part of the first clamping mechanism, the clamping collar is part of the second clamping mechanism, and the clamping collar is retractable into the clamp gap of the clamping unit when approaching the open position, wherein the clamping collar is arranged on the runner and the clamping unit is arranged on the body rail or on the furniture body; and the clamping unit has at least one clamping element moveably mounted on the clamping unit between a basic position and a locked position, which in the locked position of the clamping element narrows the width of the clamp gap such that the clamping collar is clamped between the clamping unit and a counter flange section also disposed on the clamping unit.

2. The damping device according to claim 1, wherein the clamping element is configured as a clamp roller that is rollable along an inclined plane rising in the direction of retraction of the clamping collar, the running surface of which projects slightly into the clamp gap, whereby the running surface can be travelled over by the clamping collar, which causes the clamp roller that has been travelled over to be displaced upwards on the assigned inclined plane into the locked position.

3. The damping device according to claim 2, wherein a plurality of clamp rollers are provided which are arranged one behind the other and can be travelled over in the direction of retraction of the clamping collar.

4. A piece of furniture comprising the damping device of claim 1, wherein the moveable furniture part is a drawer.

* * * * *